United States Patent [19]

James

[11] Patent Number: 4,781,531

[45] **Date of Patent: * Nov. 1, 1988**

[54] CENTRIFUGAL PUMP STAGE WITH ABRASION RESISTANT ELEMENTS

[75] Inventor: Mark C. James, Claremore, Okla.

[73] Assignee: Hughes Tool Company, Houston, Tex.

[ * ] Notice: The portion of the term of this patent subsequent to May 3, 2005 has been disclaimed.

[21] Appl. No.: 108,197

[22] Filed: Oct. 13, 1987

[51] Int. Cl.[4] ..... F04D 29/02

[52] U.S. Cl. ..... 415/212 R; 415/196; 415/199.1

[58] Field of Search ..... 415/199.1, 199.2, 199.6, 415/212 R, 196, 197, 213 R; 416/244 R

[56] References Cited

U.S. PATENT DOCUMENTS

| | | | |
|---|---|---|---|
| 892,262 | 6/1908 | Jaegee | 416/244 R |
| 1,365,006 | 1/1921 | Mjolsnes | 415/97 |
| 2,029,333 | 2/1936 | Miller | 415/172 R |
| 2,775,945 | 1/1957 | Arutunoff | 415/199.2 |
| 3,037,458 | 6/1962 | Olmstead | 415/197 |
| 3,079,866 | 3/1963 | Walker | 415/172 R |
| 3,402,670 | 9/1968 | Boyd | 415/174 |
| 3,807,894 | 4/1974 | O'Rourke | 415/199.2 |
| 4,278,399 | 7/1981 | Erickson | 415/199.1 |
| 4,499,158 | 2/1985 | Onuma et al. | 415/200 |
| 4,511,307 | 4/1985 | Drake | 415/172 R |
| 4,678,399 | 7/1987 | Vandevier et al. | 415/199.2 |

*Primary Examiner*—Robert E. Garrett
*Assistant Examiner*—John T. Kwon
*Attorney, Agent, or Firm*—James E. Bradley

[57] ABSTRACT

A centrifugal submersible pump has wear resistant features to resist erosion due to sand laden fluid from a well. The pump has a plurality of stages, each having a diffuser and an impeller located within a housing. The diffuser has a sleeve in its inner portion that has a flange on its upper end. The sleeve is a separate component from the remaining portions of the diffuser and harder. The impeller has a vane section and a hub. The hub is carried inside the sleeve. The hub has a flange that bears against the flange of the diffuser sleeve. The impeller hub is a separate component from the vane section of the impeller and is of a harder material.

3 Claims, 2 Drawing Sheets

CENTRIFUGAL PUMP STAGE WITH ABRASION RESISTANT ELEMENTS

CROSS-REFERENCE TO RELATED APPLICATION

This application is being filed simultaneously with an application entitled "Centrifugal Pump Stage with Abrasion Resistant Impeller Hub", John L. Bearden.

BACKGROUND OF THE INVENTION

1. Field of the Invention

This invention relates in general to a submersible centrifugal pumps, and in particular to wear resistant elements in the pump stages for reducing abrasion.

2. Description of the Prior Art

A submersible centrifugal pump includes a downhole electric motor coupled to a centrifugal pump. The pump has numerous stages of diffusers and impellers that pump fluid to the surface from the well. Normally the impellers and diffusers are made from a cast alloy. The impellers rotate within the diffusers, and the mating sliding surfaces are machined smooth to reduce wear and to provide close clearances for sealing. Thrust washers may be located between the impellers and diffusers to accommodate downward and upward thrust.

While these types of pumps are successful, if the fluid being pumped contains a significant amount of entrained sand, the abrasive particles will abrade and/or erode the pump impellers and diffusers, shortening the lift of the pump. Normally, a pump needs to be pulled from the well for servicing only every twelve to eighteen months. If the sand has abraded the pump components severely, the pump might have to be pulled earlier than the normal life. The cost for pulling the pump, including lost production time, can be quite expensive, particularly with offshore wells.

U.S. Pat. Nos. 4,678,399, Vandevier et al, July 7, 1987, and 4,511,307, Drake, Apr. 16, 1985, show inserts that are attached to the impeller and diffuser. These inserts are harder than the other portions of the impeller and diffuser to combat wear.

SUMMARY OF THE INVENTION

In this invention, the diffuser is of two piece construction. The diffuser has a sleeve member centrally located. The sleeve has a flange on its upper end. The sleeve is of hardened material and is joined to the diffuser.

The impeller has a vane section and a hub section. The hub has a flange that locates on the flange of the diffuser sleeve. The impeller hub rotates with the shaft. The impeller vane section is joined to the impeller hub section. Downward thrust is absorbed through the flanges of the hub section and diffuser sleeve. The impeller hub is also of a harder material than the vane section.

DESCRIPTION OF THE PREFERRED EMBODIMENT

Figure 1:
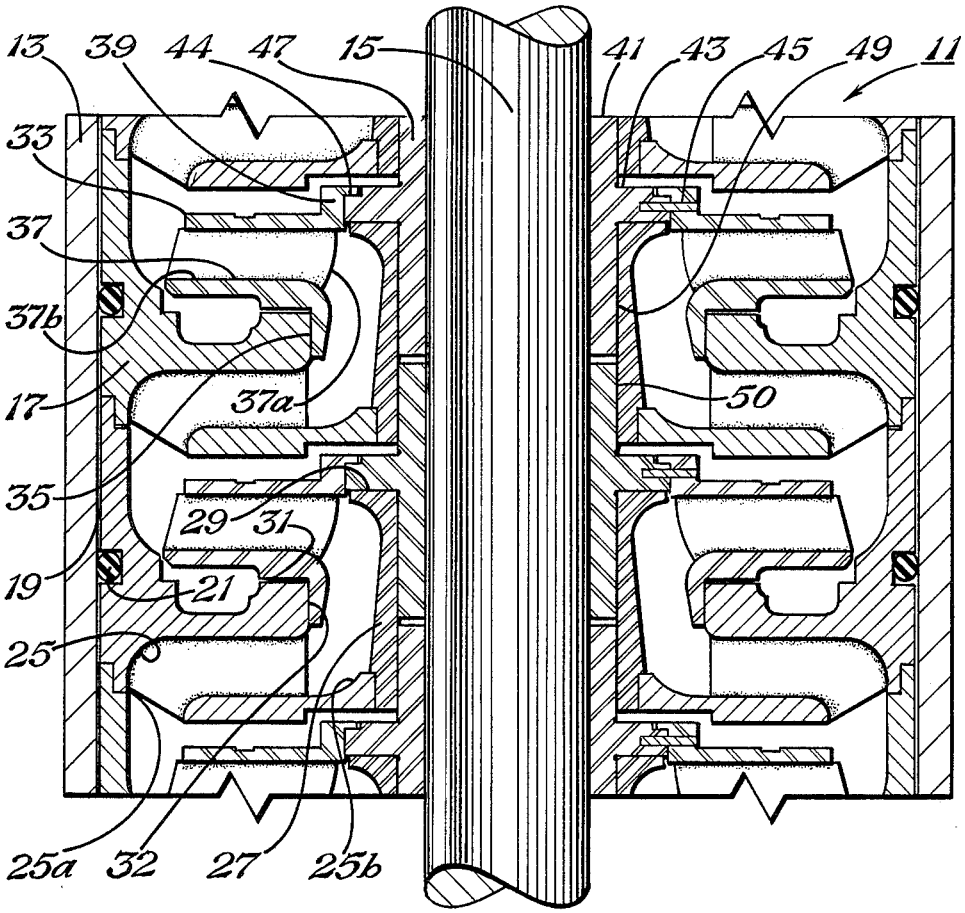
FIG. 1 is a vertical sectional view of a portion of a submersible centrifugal pump constructed in accordance with this invention.

Referring to FIG. 1, pump 11 has a cylindrical housing 13. A shaft 15 extends concentrically through the housing 13 for driving the pump 11, the shaft 15 being rotated by a submersible electric motor (not shown). The pump 11 has a plurality of pump stages, each stage including a diffuser 17.

Diffuser 17 is a tubular metal member having an outer wall 19 that is mounted stationarily inside the housing 13. An O-ring 21 is located between the outer wall 19 of each stage and the housing 13 for sealing. Diffuser 17 has a number of passages 25. Each passage 25 has an inlet **25*a* at the lower end of the diffuser 17 and located near the outer wall 19. Each passage 25 spirals upward and inward to an outlet 25*b*. Outlet 25*b* is located radially inward from the inlet 25*a***.

Diffuser 17 includes a centrally located diffuser hub or sleeve 27. The diffuser sleeve 27 is a separate member from the diffuser 17. It is of a harder material, such as hardened alloy. It is joined at its lower end to the outlet **25*b* so as to be stationary with the diffuser 17. The diffuser sleeve 27 has a flange 29** on its upper end which extends externally outward.

The diffuser 17 further has a guide surface 31 located outward from the diffuser sleeve 27 about midway along the length of the diffuser sleeve 27. A cylindrical wall 32 joins the guide surface 31.

An impeller 33 is rotatably carried by the shaft 15. Impeller 33 has an inlet portion 35 that extends downward in engagement with the cylindrical wall 32 of the diffuser 17. The impeller 33 has a vane section, which comprises a plurality of passages 37 extending upward and outward from the inlet portion 35. Each passage 37 has an inlet **37*a* located at the inlet portion 35. Each passage 37 has an outlet 37*b* located at the periphery of the impeller 33. Each impeller 33 has a flange 39 on its upper side located adjacent and outward from the diffuser flange 29. Flange 39 extends upward a short distance above the top of the vane section of impeller 33**.

Each impeller 33 has a hub portion 41 which joins the vane section previously described. The hub 41 is a separate member that is of a material, such as a hardened metal alloy, that is harder than the remaining portions of the impeller 33. The hub 41 has an external flange 43. Flange 43 is secured to the flange 39 of the impeller 33 by a fastening means such as a plurality of pins 45. The hub 41 has on its upper end an upward facing shoulder 44. A part of the vane section flange 39 is located on top of the shoulder 44. The hub 41 is slidingly received on the shaft 15. A key (not shown) located between the shaft 15 and the hub 41 causes the hub 41 to rotate with the shaft 15. The hub 41 is free for slight axial movement relative to the shaft 15, however.

The hub 41 has a lower portion 49 and an upper portion 50. The lower portion 49 extends downward from the flange 43 and is slidingly received inside the diffuser sleeve 27. The upper portion 50 extends upward from the flange 43 and is slidingly received in the diffuser sleeve 27 of the next upward stage.

In operation, shaft 15 will be rotated by the electric motor (not shown). Shaft 15 rotates each impeller hub 41, which in turn causes the impeller 33 to rotate. Fluid will flow up the diffuser passages 25 into the impeller passages 37 and then back into the diffuser passages 25 of the next upward stage.

The discharge of fluid in an upward direction creates a downward thrust on the impellers 33. The downward thrust of each impeller 33 is transmitted through shoulder 44 and impeller hub flange 43 by the vane flange 39 of the impeller 33. The force is transmitted from the impeller hub flange 43 to the diffuser sleeve flange 29. The impeller hub flange 43 will be rotating in sliding engagement with the stationary diffuser sleeve flange 29. Both of the flanges 29 and 43 are of hardened materials to retard wear.

The upper and lower portions 49, 50 provide radial support by rotating inside the diffuser sleeve 27. These surfaces are hardened to retard wear. Normally, a slight clearance will exist between the impeller 33 and the guide surface 31, with all of the thrust being absorbed through the flange 29, 43. In the case of upward thrust, the top of the impeller flange 43 and the bottom edge of the diffuser sleeve 27 contact each other. These surfaces are hardened to carry the upward thrust and enhance upward thrust wear capability.

Figure 2:
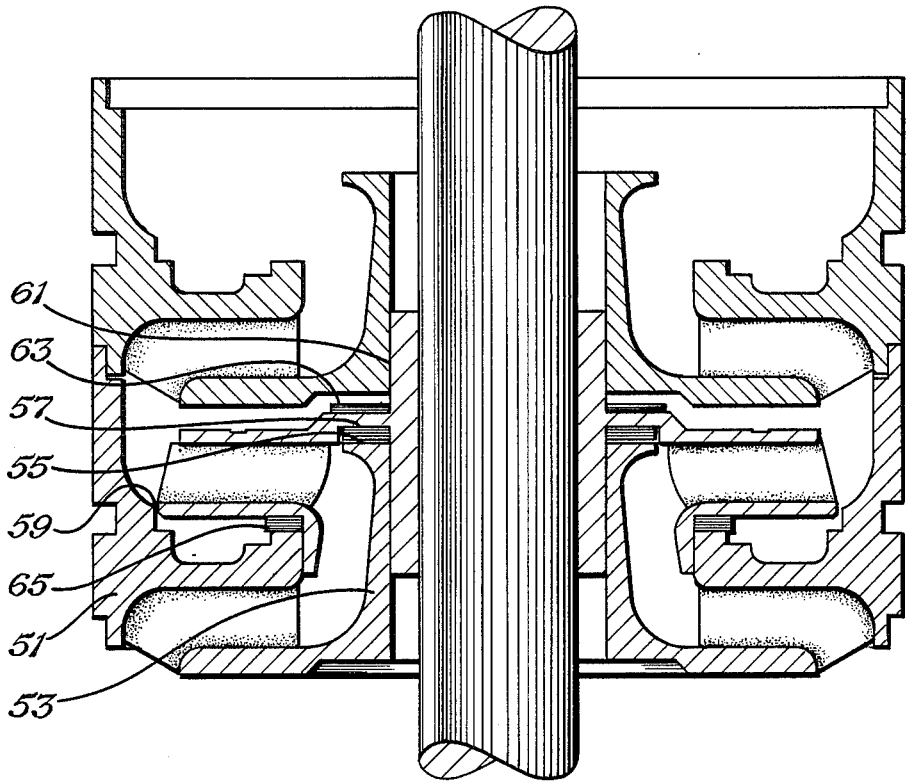
Fig. 2 (PRIOR ART)
FIG. 2 is a sectional view of the portions of a prior art conventional pump.

The difference between the invention as shown in FIG. 1 and the prior art is shown in FIG. 2. In FIG. 2, the diffuser 51 has a diffuser sleeve 53 integrally formed with it. The sleeve 53 is of the same material as the remaining portions of the diffuser 51, and is not hardened. The diffuser sleeve 53 has a diffuser flange 55 on its upper end which receives thrust washers 57.

The impeller 59 has a hub 61 that is integrally formed with the impeller 59. The hub 61 is not of a different material than the impeller 59. Thrust washers 63 are located on the impeller 59 immediately above the washers 57 for absorbing any upward thrust that may be encountered. There is also a set of thrust washers 65 to assist in absorbing downward thrust. These thrust washers are located below the impeller vane section.

The invention has significant advantages. The two piece impeller and the two piece diffuser allow hardened components to be used to retard wear. With a substitution of the two hardened components, all bearing areas subject to high wear in both radial and axial directions are addressed.

While the invention has been described in only one of its forms, it should be apparent to those skilled in the art that it is not so limited, but is susceptible to various changes without departing from the scope of the invention.

I claim:

1. In a submersible centrifugal pump of the type having a housing, a drive shaft extending through the housing, a plurality of diffusers mounted stationarily in the housing, each diffuser having a plurality of passages with a lower inlet and an upper outlet, a plurality of impellers, each mounted to the shaft for rotation therewith, each impeller having a plurality of passages with an inlet for receiving fluid from the outlets of an adjacent lower diffuser and an upper outlet for discharging fluid to the inlets of an adjacent upper diffuser, the improvement comprising:

the diffuser having a diffuser sleeve extending upward from the upper outlet of the diffuser, the diffuser sleeve being of a material harder than the remaining portions of the diffuser and having an upper edge; and the impeller having an impeller hub carried by the shaft inside the diffuser hub for rotation with the shaft, the impeller hub having a flange that engages the upper edge of the diffuser sleeve in rotating sliding contact to transmit downward thrust on the impeller to the diffuser, the impeller hub being of a material harder than the remaining portions of the impeller.

2. In a submersible centrifugal pump of the type having a housing, a drive shaft extending through the housing, a plurality of diffusers mounted stationarily in the housing, each diffuser having a plurality of passages with a lower inlet and an upper outlet, a plurality of impellers, each mounted to the shaft for rotation therewith, each impeller having a plurality of passages with an inlet for receiving fluid from the outlets of an adjacent lower diffuser and an upper outlet for discharging fluid to the inlets of an adjacent upper diffuser, the improvement comprising:

a diffuser having a diffuser sleeve rigidly joined thereto and extending upward from an inner edge of the upper outlet of the diffuser, the diffuser sleeve being of a material harder than the diffuser and having an external flange on its upper end;

an impeller having a vane section and a hub, the hub being carried by the shaft inside the diffuser sleeve for rotation with the shaft, the impeller hub having an external flange located intermediate an upper and lower end of the impeller hub, the impeller vane section being secured to the impeller hub for rotation therewith; and the flange of the impeller hub overlying and slidingly contacting the flange of the diffuser hub to transmit downward thrust on the impeller to the flange of the impeller hub and to the flange of the diffuser hub, the impeller hub being of a material harder than the vane section of the impeller.

3. In a submersible centrifugal pump of the type having a housing, a drive shaft extending through the housing, a plurality of stages, each stage having a diffuser mounted stationarily in the housing, each diffuser having a plurality of passages with a lower inlet and an upper outlet, each stage having an impeller, each impeller mounted to the shaft for rotation therewith, each impeller having a plurality of passages with an inlet for receiving fluid from the outlets of an adjacent lower diffuser and an upper outlet for discharging fluid to the inlets of an adjacent upper diffuser, the improvement comprising in combination:

the diffuser having a diffuser sleeve extending upward from an inner edge of the upper outlet of the diffuser and rigidly joined thereto, the diffuser sleeve being of a material harder than remaining portions of the diffuser and having an external flange on its upper end;

the impeller having a vane section which contains the impeller passages and an impeller hub, the impeller hub being carried by the shaft inside the diffuser sleeve for rotation with the shaft, the impeller hub having an external flange located intermediate the ends of the impeller hub, defining an upper portion above the impeller flange and a lower portion below the impeller flange, the upper portion extending upward into the diffuser sleeve of the next upward stage;

the impeller vane section having a flange located adjacent the flange of the impeller hub; and means for joining the flange of the impeller vane section to the flange of the impeller hub to cause the impeller vane section to rotate with the impeller hub;

the flange of the impeller hub overlying and slidingly contacting the flange of the diffuser hub to transmit downward thrust on the impeller vane section to the flange of the impeller hub and thence to the flange of the diffuser sleeve, the impeller hub being of a material harder than the impeller vane section.

* * * * *